US005619218A

United States Patent [19]

Salvail et al.

[11] Patent Number: 5,619,218

[45] Date of Patent: Apr. 8, 1997

[54] COMMON APERTURE ISOLATED DUAL FREQUENCY BAND ANTENNA

[75] Inventors: Gary Salvail; I-Ping Yu, both of Tucson, Ariz.

[73] Assignee: Hughes Missile Systems Company, Los Angeles, Calif.

[21] Appl. No.: 468,213

[22] Filed: Jun. 6, 1995

[51] Int. Cl.[6] ..... H01Q 1/36

[52] U.S. Cl. ..... 343/895

[58] Field of Search ..... 343/895; H01Q 1/36

[56] References Cited

U.S. PATENT DOCUMENTS

| | | | |
|---|---|---|---|
| 3,017,633 | 1/1962 | Marston et al. | 343/895 |
| 3,135,960 | 6/1964 | Kaiser | 343/895 |
| 3,192,531 | 6/1965 | Cox et al. | 343/895 |
| 3,381,371 | 5/1968 | Russell | 343/895 |
| 3,787,871 | 1/1974 | Reese | 343/895 |
| 4,032,921 | 6/1977 | Sikina et al. | 343/895 X |
| 4,087,821 | 5/1978 | Phelan | 343/895 X |
| 4,573,212 | 2/1986 | Lipsky | 343/895 X |

*Primary Examiner*—Donald T. Hajec
*Assistant Examiner*—Tho Phan
*Attorney, Agent, or Firm*—Charles D. Brown; Wanda K. Denson-Low

[57] ABSTRACT

An antenna comprising a substrate, and low band and high band opposite sense spiral antennas formed on the substrate to provide for a common aperture isolated dual frequency band antenna. The high band spiral antenna is formed adjacent the center of the substrate while the low band spiral antenna is formed adjacent the periphery of the substrate. The high frequency end of the low band antenna is truncated at the low frequency end of the high band antenna, and the low frequency end of the high frequency antenna is truncated at the high frequency end of the low band antenna 21 to provide for mutual isolation between the frequency bands.

11 Claims, 1 Drawing Sheet

COMMON APERTURE ISOLATED DUAL FREQUENCY BAND ANTENNA

BACKGROUND

The present invention relates generally to antennas, and more particularly, to a common aperture isolated dual frequency band antenna.

Space for antennas is typically a premium on missiles, and other airframes. When two antennas are in close proximity and one antenna is used to transmit while the other is simultaneously used to receive, the transmitting antenna can overload the receiver of the receiving antenna causing the system to malfunction, or be destroyed. This problem is conventionally overcome by placing the antennas further apart or by blanking the receive antenna while the other one transmits. This is costly and makes for a more complicated system than may be desired.

One prior art antenna form used in this situation involves the use of two opposite sense spiral antennas. The disadvantage of this antenna configuration is that there are two antennas that take up a relatively large amount of area, roughly twice the area as the present invention. Another antenna form is a sinuous spiral antenna that receives both senses at the same time. The drawback with the sinuous spiral antenna is that it cannot simultaneously receive the two signals at the different frequencies and separate them into different channels of a receiver. Therefore, there is no isolation of the two signals.

Accordingly, it is an objective of the present invention to provide for a common aperture isolated dual frequency band antenna. It is another objective of the present invention to provide for an antenna that simultaneously provides for transmission and reception of two different frequencies in relatively compact package, and that isolates these two different frequencies from each other.

SUMMARY OF THE INVENTION

To meet the above and other objectives, the present invention provides for a common aperture isolated dual frequency band antenna. The common aperture isolated dual frequency band antenna comprises a substrate having first and second surfaces, and low band and high band spiral antennas formed on the substrate.

The low band spiral antenna comprises a first termination disposed on the first surface of the substrate adjacent the periphery thereof. Conductive metallization is coupled to the first termination and is disposed on the first surface of the substrate that spirals in a first direction from the first termination a predetermined distance towards the center of the substrate. First and second vias are disposed through the substrate that couple the metallization to the second surface of the substrate. Second surface metallization connects between the first and second vias. Conductive metallization is coupled to the second via and spirals in a second direction increasing in diameter as it progresses toward the periphery of the substrate. A first connector or feed is provided for the first antenna and may be coupled to the conductive metallization.

The high band spiral antenna comprises a second termination disposed adjacent an innermost spiral of metallization of the low band antenna. Conductive metallization is disposed on the first surface of the substrate that spirals in the second direction from the second termination toward the center of the substrate. Conductive metallization spirals in the first direction from the center of the substrate toward the innermost spiral of metallization of the low band antenna. A conductive jumper is coupled between the conductive metallizations that spiral in the first and second directions. A second connector or feed is provided for the second antenna and may be coupled to the conductive metallization that spirals in the second direction.

The present invention is thus comprised of one antenna substrate containing two spiral antennas. The two spiral antennas operate at different frequency bands. The two spiral antennas are configured to have opposite sense and are fed separately. The present antenna is a compact package containing the two spiral antennas that share the same aperture and has excellent isolation between the two frequency bands.

The present invention takes up the space of one antenna while it provides the functions of two antennas. Additionally, the present antenna provides good isolation between the two frequency bands. The present invention uses two spiral antennas of opposite sense on the same substrate, preferably fed by a common feed cavity.

The present antenna may be constructed using a coaxial-type cable to form antenna traces and when using such cables it is convenient to form a balun by interconnecting center conductors to jackets of the cable. The present antenna may also be made using stripline to form the conductive traces of the spiral. However, the balun is not as simple to form as in the case of the coaxial-type cable. Neither embodiment (coaxial or stripline) requires the use of a balun, but the use of the balun provides for a more efficient antenna.

The present antenna may also operate without a cavity, but not on a missile body, for example. The high frequency end of the low band spiral antenna is truncated at the low frequency end of the high band spiral. Also, the low frequency end of the high frequency spiral is truncated at the high frequency end of the low band spiral. This further contributes to mutual isolation between frequency bands of the two antennas.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
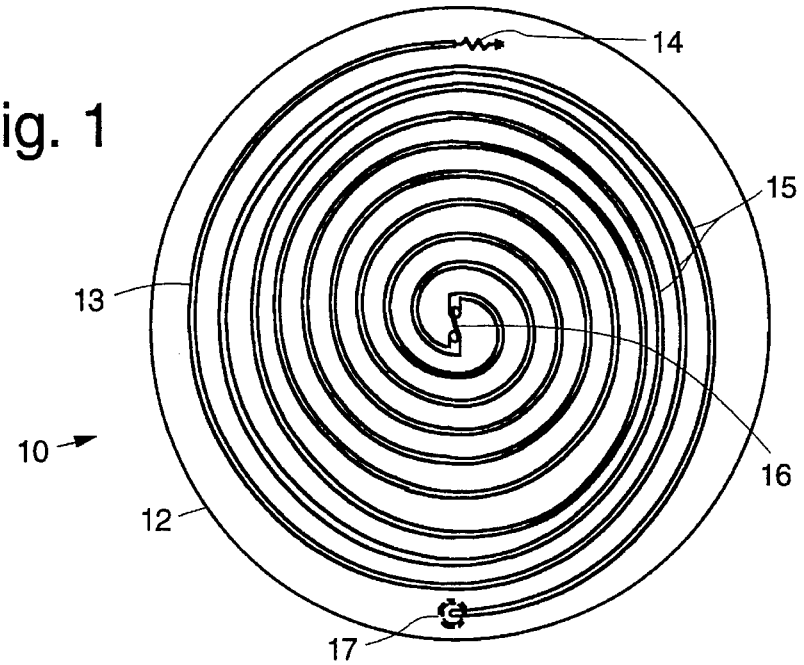
FIG. 1 is a top view of a conventional dual frequency band antenna.
Figure 2:
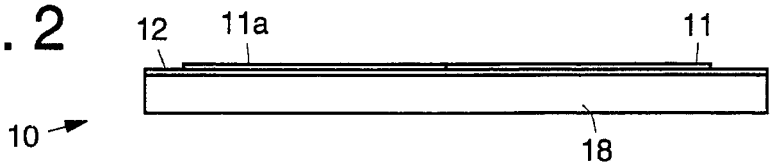
FIG. 2 is a side view of the conventional dual frequency band antenna of FIG. 1.

Referring to the drawing figures, FIG. 1 is a top view of a conventional dual frequency band antenna 10, while FIG. 2 is a side view of the antenna 10 of FIG. 1. The conventional dual frequency band antenna 10 comprises two separate antennas 11, 11*a* that are each comprised of a circular substrate 12 upon which a spiral antenna 13 is formed. The spiral antenna 13 is terminated at one end by a termination 14 adjacent the periphery of the substrate 12. Conductive metallization 15 is disposed on one surface of the substrate 12 and spirals in a counterclockwise direction, for example, from the termination 14 to the center of the substrate 12. At the center of the substrate 12 a conductive jumper 16 couples to conductive metallization 15 that spirals in a clockwise direction from the center of the substrate 12 to a connector 17, such as an SMA connector 17, disposed adjacent the periphery of the substrate 12. The two spiral antennas 11, 11 a are stacked on top of each other and are coupled to a cavity 18. One antenna 11 comprises a transmit antenna 11 while the other antenna 11 a comprises a receive antenna 11*a*.

Figure 3:
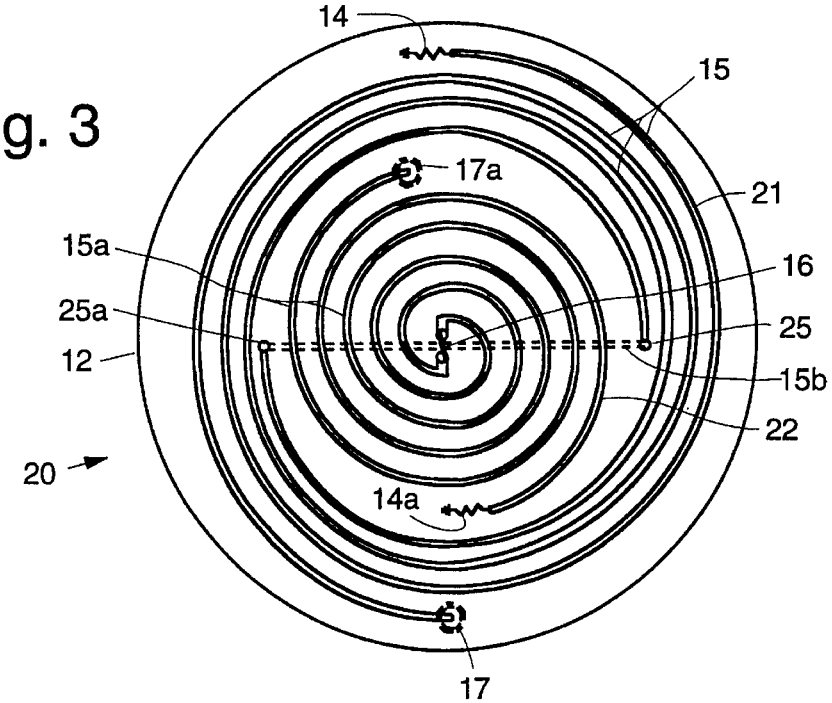
FIG. 3 is a top view of a common aperture isolated dual frequency band antenna in accordance with the present invention.
Figure 4:
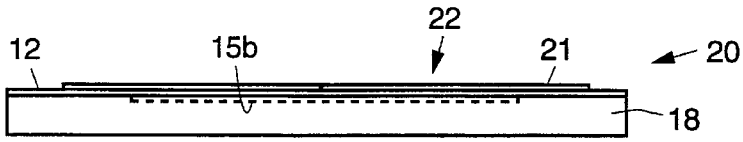
FIG. 4 is a side view of the common aperture isolated dual frequency band antenna of FIG. 3.

Referring to FIG. 3, it is a top view of one embodiment a common aperture isolated dual frequency band antenna 20 in accordance with the present invention, while FIG. 4 is a side view of the antenna 20 of FIG. 3. The common aperture isolated dual frequency band antenna 20 comprises two separate concentrically disposed spiral antennas 21, 22 that are formed on a single circular substrate 12. One spiral antenna 21 forms a low band spiral antenna 21, while the other spiral antennas 22 forms a high band spiral antenna 22 and is disposed within the low band spiral antenna 21.

The low band spiral antenna 21 is terminated at one end by a first termination 14 adjacent the periphery of the substrate 12. Conductive metallization 15 is disposed on a first surface of the substrate 12 and spirals in a first direction, clockwise for example, from the first termination 14 towards the center of the substrate 12, to a distance of about one half the radius of the substrate 12. At this point, the conductive metallization 15 transitions to a second surface of the substrate 12 by way of a first via 25 and second surface metallization 15*b* that connects to a second via 25*a* and back to the metallization 15 on the first surface of the substrate 12. The metallization 15 spirals in a second direction, counterclockwise for example, increasing in diameter as it progresses toward the periphery of the substrate 12. At the periphery of the substrate 12 the metallization 15 terminates at a first connector 17*a*, such as an SMA connector 17*a*, for example. The first connector 17*a* or feed 17*a* couples energy from the cavity 18 into the low band spiral antenna 21, or directly from transmit and receive sources without the use of the cavity 18.

The high band antenna 22 disposed within the low band antenna 21 is terminated at one end by a second termination 14*a* disposed adjacent an innermost spiral of metallization 15 of the low band antenna 21. Conductive metallization 15*a* is disposed on the first surface of the substrate 12 and spirals in the second direction, counterclockwise from the second termination 14*a* toward the center of the substrate 12. At the center of the substrate 12 a conductive jumper 16 couples to conductive metallization 15*a* that spirals in the first direction, clockwise, from the center of the substrate 12 to a second feed 17*b* or connector 17*b*, that couples energy into and out of the high band spiral antenna 22. The connector 17*b* may be an SMA connector 17*b*, for example, disposed adjacent the innermost spiral of metallization 15 of the low band antenna 21. The two spiral antennas 21, 22 are optionally coupled to the cavity 18 by means of the first and second connectors 17*a*, 17*b* or feeds 17*a*, 17*b*.

The low band and high band antennas 21, 22 are of opposite sense, in that they spiral in opposite directions, and are fed separately with fight hand and left hand circularly polarized energy. This minimizes the coupling between the antennas 21, 22, along with the fact that they radiate and receive energy in different frequency bands. The high frequency end of the low band spiral antenna 21 is truncated at the low frequency end of the high band spiral antenna 22. Also, the low frequency end of the high frequency spiral antenna 22 is truncated at the high frequency end of the low band spiral antenna 21. This further contributes to mutual isolation between the frequency bands transmitted and received by the two antennas 21, 22.

The present antenna 20 may be constructed using conductors of a coaxial-type cable, for example, to form the antenna traces. When using the coaxial-type cable, it is convenient to form a balun by interconnecting center conductors to jackets of the cable. A typical balun is illustrated by the use of the second surface metallization 15*b* shown in FIGS. 3 and 4, for example. The present antenna 20 may also be made using stripline to form the conductive metallization 15, 15*a* of the spiral. However, the balun is not as simple to form as in the case of the coaxial-type cable metallization. More importantly, neither embodiment (coaxial or stripline) requires the use of a balun, but the use of the balun provides for a more efficient antenna 20. Furthermore, the terminations 14, 14*a* are not required for all applications, but their use typically provides for a more efficient antenna 20. In addition, the low band antenna 21 may be fed at the ends of the spirals adjacent the conductive jumper 16 (which would not be used), instead of at the feeds 17*a*, 17*b*.

The common aperture isolated dual frequency band antenna 20 was developed to meet antenna requirements for an Evolved Sea Sparrow Missile (ESSM) planned for development by the assignee of the present invention. There is very little space in the body of this missile for an antenna and minimal antenna crosstalk was required. consequently, the present antenna 20 filled this need by providing dual frequency band capability along with minimal crosstalk because of its unique design. The present antenna 20 may also be used in automobile applications such as in collision avoidance radars, for example, where more than one frequency is desired from a compact antenna where crosstalk must be kept to a minimum.

Thus, a common aperture isolated dual frequency band antenna has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A common aperture isolated dual frequency band antenna comprising:

a substrate having first and second surfaces;

a low band spiral antenna formed on the substrate that comprises:

a first termination disposed adjacent the periphery of the substrate;

first conductive metallization disposed on the first surface of the substrate and coupled to the first termination that spirals in a first direction from the first termination a predetermined distance towards the center of the substrate;

a first via disposed through the substrate for coupling the first conductive metallization to the second surface of the substrate;

a second vias disposed through the substrate;

second surface metallization disposed on the second surface of the substrate connected between the first and second vias;

second conductive metallization disposed on the first surface of the substrate and coupled to the second via that spirals in a second direction increasing in diameter as it progresses toward the periphery of the substrate; and a first feed that is coupled to the second conductive metallization; and a high band spiral antenna formed on the substrate that comprises:

a second termination disposed adjacent an innermost spiral of metallization of the low band antenna;

third conductive metallization disposed on the first surface of the substrate that spirals in the second direction from the second termination toward the center of the substrate;

fourth conductive metallization disposed on the first surface of the substrate that spirals in the first direction from the center of the substrate toward the innermost spiral of metallization of the low band antenna;

a conductive jumper coupled between the third and fourth conductive metallizations; and a second feed coupled to the fourth conductive metallization.

2. The antenna of claim 1 wherein the high frequency end of the low band spiral antenna is truncated, and wherein the low frequency end of the high frequency spiral antenna is truncated to provide mutual isolation between the frequency bands.

3. The antenna of claim 1 which further comprises a cavity disposed adjacent to the second surface of the substrate for coupling energy into and out of the low band and high band antennas.

4. The antenna of claim 1 wherein the first and second feeds couple energy to and from a cavity into and out of the low band and high band antennas.

5. A common aperture isolated dual frequency band antenna comprising:

a substrate;

a low band spiral antenna formed on the substrate that comprises:

a first termination;

first conductive metallization disposed on the substrate and coupled at one end to the first termination that spirals in a first direction a predetermined distance from the first termination and thereafter spirals in a reverse direction;

a first feed coupled to a second end of the first conductive metallization that couples energy to and from the first conductive metallization; and a high band spiral antenna formed on the substrate that comprises:

a second termination;

second conductive metallization concentrically disposed on the substrate within the first conductive metallization and coupled at one end to the second termination that spirals in the second direction from the second termination and that thereafter spirals in a reverse direction; and a second feed that couples energy to and from the second conductive metallization.

6. The antenna of claim 5 wherein the first conductive metallization comprises:

first conductive metallization disposed on a first surface of the substrate and coupled to the first termination that spirals in a first direction from the first termination a predetermined distance towards the center of the substrate;

first and second vias disposed through the substrate for coupling the first conductive metallization to the second surface of the substrate;

second surface metallization disposed on a second surface of the substrate connected between the first and second vias; and first conductive metallization disposed on a first surface of the substrate and coupled to the second via that spirals in a second direction increasing in diameter as it progresses toward the periphery of the substrate.

7. The antenna of claim 5 wherein the second conductive metallization comprises:

second conductive metallization disposed on the first surface of the substrate that spirals in the second direction from the second termination toward the center of the substrate;

second conductive metallization disposed on the first surface of the substrate that spirals in the first direction from the center of the substrate toward the innermost spiral of metallization of the low band antenna;

a conductive jumper coupled between the second conductive metallizations that spiral in the first and second directions.

8. The antenna of claim 5 wherein a high frequency end of the low band spiral antenna is truncated, and wherein a low frequency end of the high frequency spiral antenna is truncated to provide mutual isolation between the frequency bands.

9. The antenna of claim 5 which further comprises a cavity disposed adjacent to the substrate for coupling energy into and out of the low band and high band antennas.

10. The antenna of claim 5 wherein the first and second feeds couple energy to and from a cavity into and out of the low band and high band antennas.

11. A common aperture isolated dual frequency band antenna comprising:

a substrate having first and second surfaces;

a low band spiral antenna formed on the substrate that comprises:

a first termination disposed on the first surface of the substrate adjacent the periphery thereof;

first conductive metallization disposed on the first surface of the substrate and coupled to the first termination that spirals in a first direction from the first termination a predetermined distance towards the center of the substrate;

a first via disposed through the substrate for coupling the first conductive metallization to .the second surface of the substrate;

a second vias disposed through the substrate;

second surface metallization connected between the first and second vias;

second conductive metallization disposed on the first surface of the substrate and coupled to the second via that spirals in a second direction increasing in diameter as it progresses toward the periphery of the substrate; and a first feed coupled to the second conductive metallization that couples energy to and from the low band spiral antenna; and a high band spiral antenna formed on the substrate that comprises:

a second termination disposed adjacent an innermost spiral of metallization of the low band antenna;

third conductive metallization disposed on the first surface of the substrate that spirals in the second direction from the second termination toward the center of the substrate;

fourth conductive metallization disposed on the first surface of the substrate that spirals in the first direction from the center of the substrate toward the innermost spiral of metallization of the low band antenna;

a conductive jumper coupled between the third and fourth conductive metallizations; and a second feed that couples energy to and from the high band spiral antenna.

* * * * *